United States Patent [19]

Schumacher

[11] 4,233,910

[45] Nov. 18, 1980

[54] RAILWAY CAR HYDRAULICALLY DAMPENED TRACTION RODS

[75] Inventor: Friedrich Schumacher, Mülheim-Saarn, Fed. Rep. of Germany

[73] Assignee: Fried. Krupp Gesellschaft mit beschränkter Haftung, Essen, Fed. Rep. of Germany

[21] Appl. No.: 935,117

[22] Filed: Aug. 21, 1978

[30] Foreign Application Priority Data

Aug. 23, 1977 [DE] Fed. Rep. of Germany ..... 2737834

[51] Int. Cl.[3] ..... B61F 3/08; B61F 5/16; B61F 5/50

[52] U.S. Cl. ..... 105/182 R; 105/168; 105/176; 105/199 R; 105/200

[58] Field of Search ..... 105/168, 176, 182 R, 105/196, 199 R, 200, 208

[56] References Cited

U.S. PATENT DOCUMENTS

| | | | |
|---|---|---|---|
| 488,255 | 12/1892 | Shaw | 105/176 |
| 3,376,831 | 4/1968 | Eaton et al. | 105/199 R |
| 3,528,374 | 9/1970 | Wickens | 105/168 X |
| 3,719,153 | 3/1973 | Schumacher | 105/182 R |
| 3,854,420 | 12/1974 | Hinnen et al. | 105/176 |

*Primary Examiner*—Howard Beltran
*Attorney, Agent, or Firm*—Becker & Becker, Inc.

[57] ABSTRACT

A rail vehicle, especially self-propelled vehicle, in which pulling and braking forces are transmitted between pivotless bogies and the main frame of the rail vehicle, and in which on both vehicle sides, symmetrically with regard to the longitudinal central axis of the rail vehicle, pressure and pull rods are on one hand connected to the outside of the bogies and on the other hand to hydraulic cylinder-piston systems connected to the main frame. The corresponding working chambers of the hydraulic cylinders on both sides of the vehicle are respectively adapted to communicate with each other. On each vehicle side between two bogies, there is arranged one hydraulic cylinder-piston only which has two separately acting working pistons each respectively connected to a pressure rod and pull rod. Each of the three working chambers formed by the above mentioned two working pistons of the hydraulic cylinder-piston systems is on one vehicle side adapted to be connected with the corresponding working chamber of the hydraulic cylinder-piston system arranged on the other vehicle side.

4 Claims, 8 Drawing Figures

20
14
17
15
19
16
18
24
13
26
25
12
11
27
21
23
22
13'
11'
27'
17'
15'
19'
16'
18'

RAILWAY CAR HYDRAULICALLY DAMPENED TRACTION RODS

The present invention relates to a device for transmitting pulling and braking forces between pivotless bogies and the main frame of bogie-rail vehicles, especially self-propelled vehicles, in which symmetrically with regard to the central longitudinal axis of the rail vehicle, on both vehicle sides, pressing rods and pulling rods on one hand are connected with the bogies at their outer side and on the other hand are connected to the hydraulic cylinders which are connected to the main frame, and in which device the corresponding working chambers of the hydraulic cylinders are on both sides in fluid communication with each other.

Rail vehicles with pivotless bogies and with hydraulic cylinders arranged on the main frame while the pistons of said hydraulic cylinders are connected to the pulling and pressing rods have become known from U.S. Pat. No 3,719,153 Schumacher issued Mar. 6, 1973 belonging to the assignee of the present invention. The corresponding working chambers of the cylinders of the joint systems are filled with liquid and are interconnected through a pipeline. The connecting lines are expediently provided with pressure storage means, feed and outlet valves as well as with safety valves. This known device comprises a vehicle with two bogies and at least four hydraulic cylinder piston systems.

For rail vehicles to an ever increasing extent, a light and simple design with good running properties is required.

It is, therefore, an object of the present invention on one hand to utilize the advantages of the heretofore known hydraulic devices, and on the other hand to lighten the construction of the above mentioned device and make it simpler and to thereby save costs.

Figure 1A:
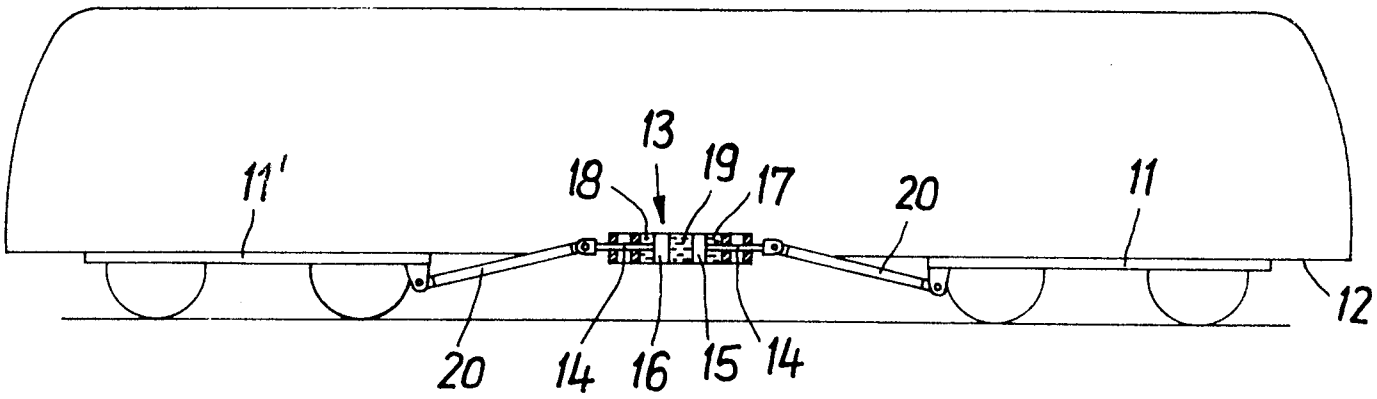

These and other objects and advantages of the invention will appear more clearly from the following specification in connection with the accompanying drawings, in which:

FIG. 1*a* illustrates in side view a vehicle equipped with the device according to the invention and comprising two 2-axle bogies which through the intervention of four pulling-pressing rods are connected to hydraulic cylinders fastened to the main frame.

Figure 1B:
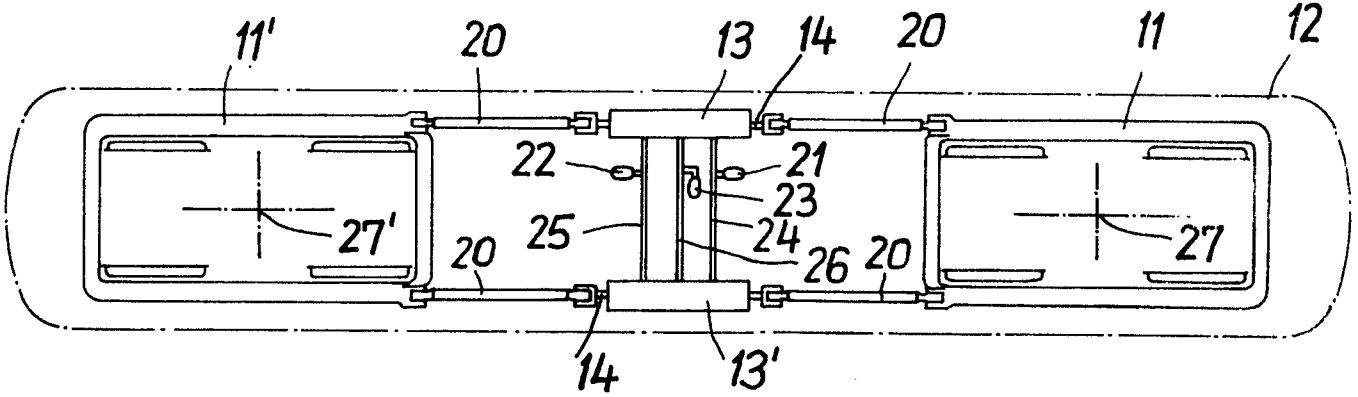

FIG. 1*b* shows the device according to the invention in the cutting plane located at the level of the bottom edge of the main frame, as seen from above.

Figure 2:
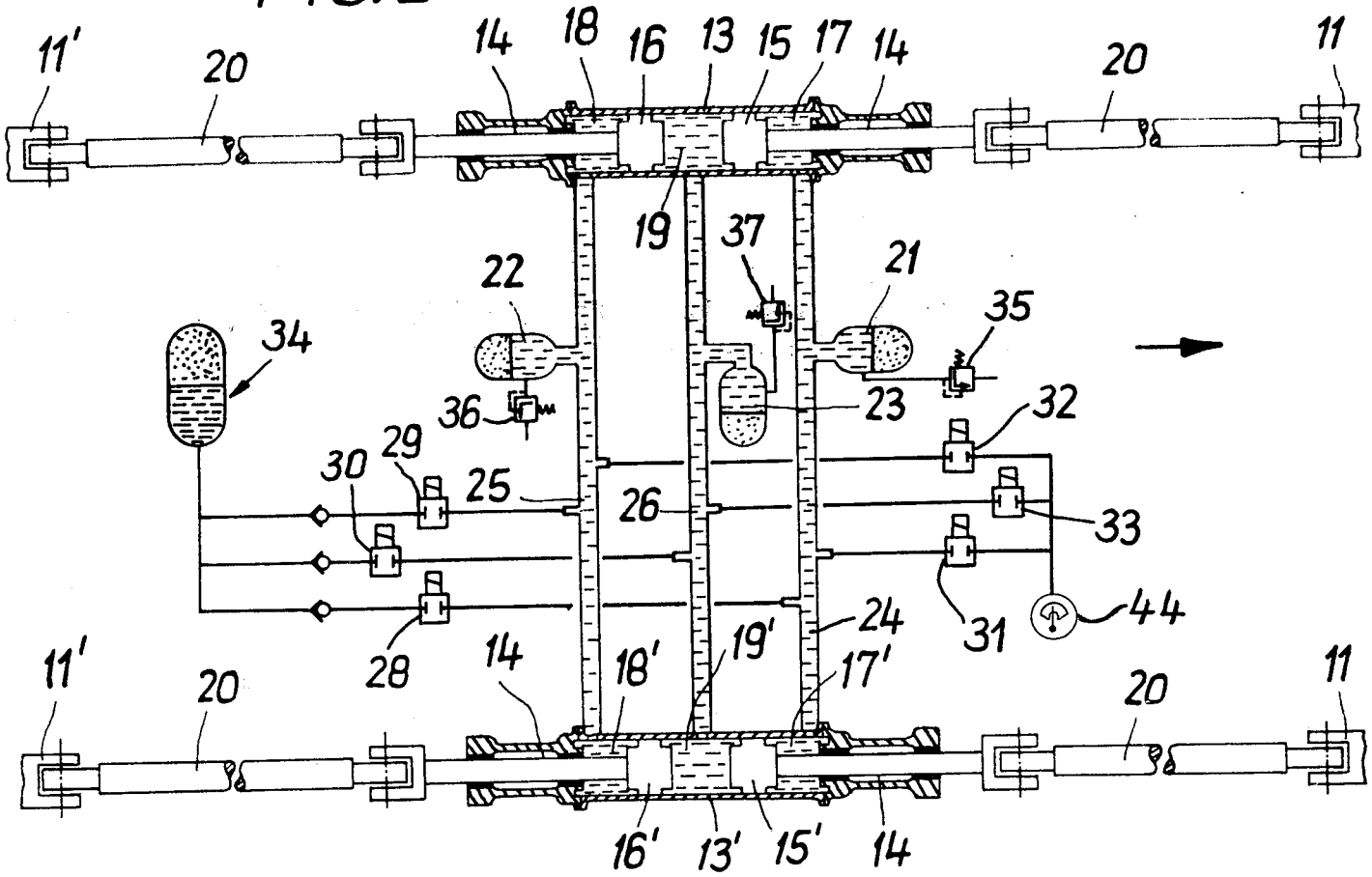

FIG. 2 diagrammatically shows the hydraulic system of the device with the working pistons occupying their normal position.

Figures 3, 3A, 3B:
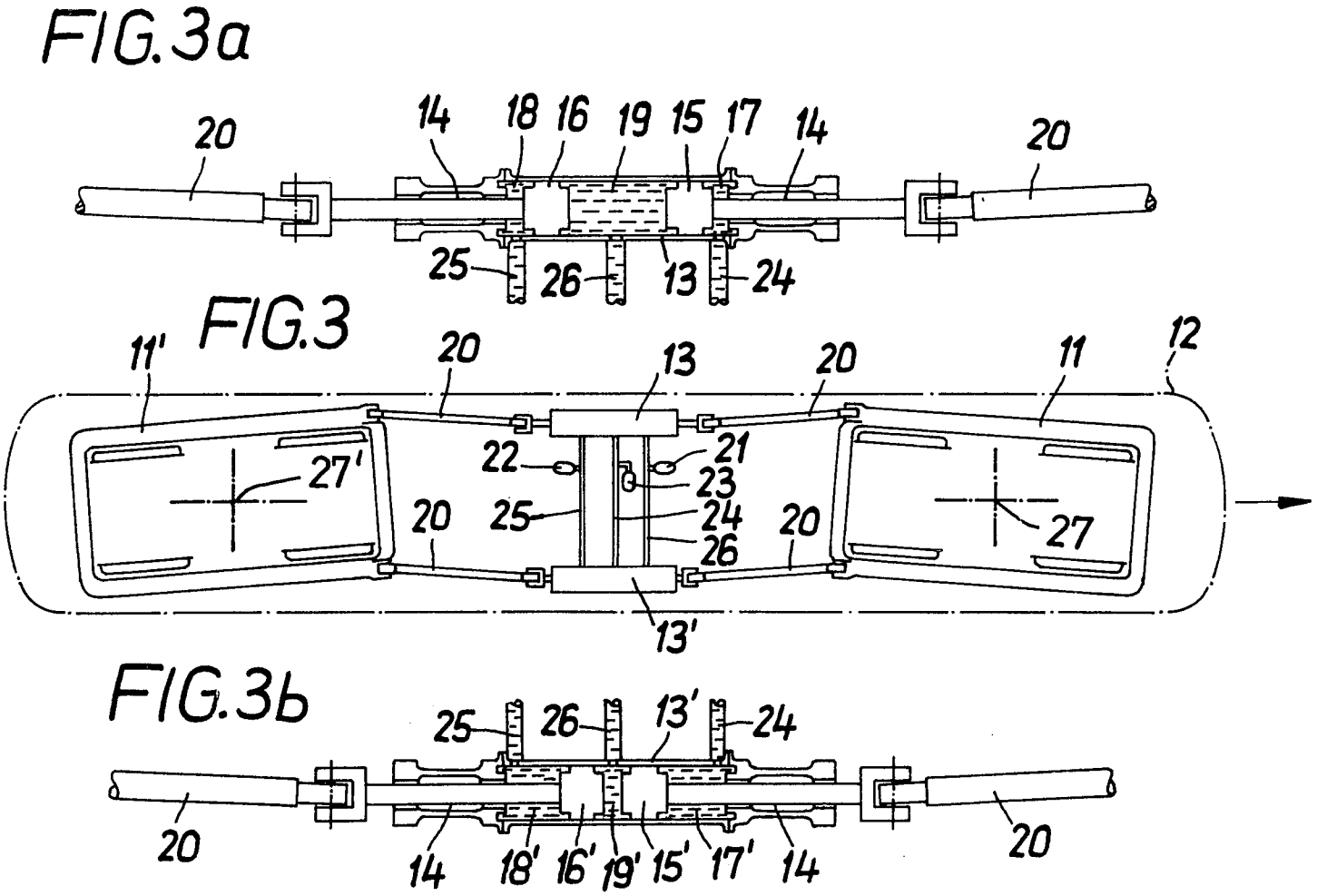

FIG. 3 diagrammatically illustrates the hydraulic system of the device with the working pistons occupying their extreme position and with the bogies in pivoted position.

FIGS. 3*a* and 3*b* illustrate the position of the working pistons which, when viewed in driving direction, operate on the left and right hand side of the main frame, while the vehicle passes through a curved rail track.

Figure 4A:
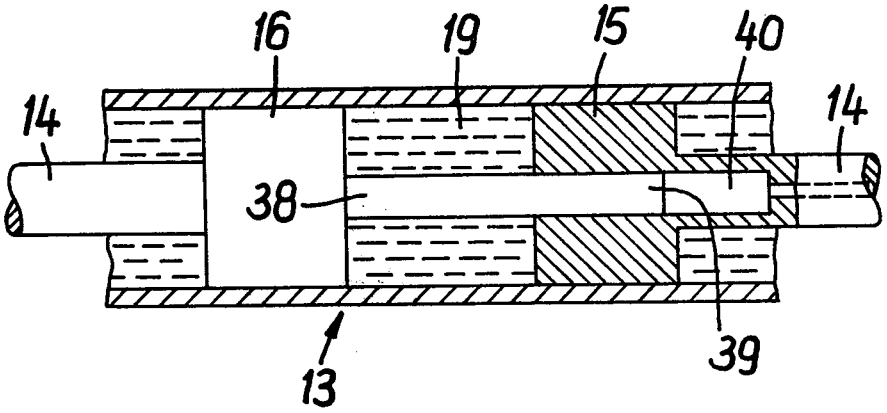

FIG. 4*a* shows a unilaterally fastened telescopic bar between the working pistons.

Figure 4B:
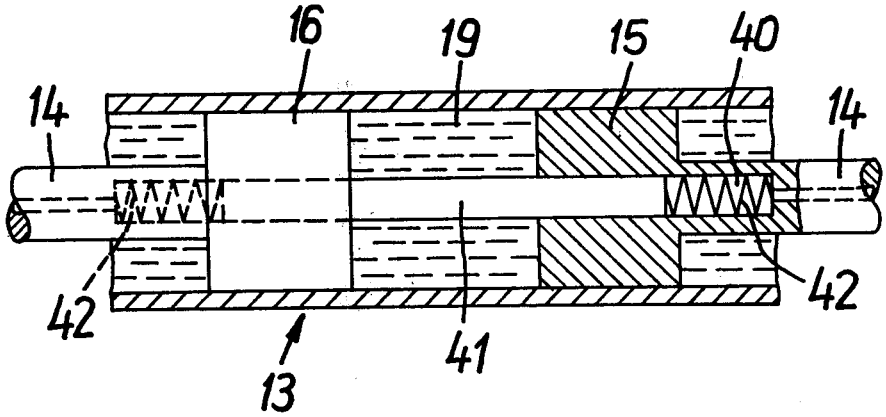

FIG. 4*b* shows a telescopic bar between the working pistons which is freely guided on both sides.

The device according to the present invention is characterized primarily in that between two bogies on each vehicle side only one hydraulic cylinder is provided which comprises two separately acting working pistons with one pressing and pulling rod each. The device according to the invention is furthermore characterized in that each of the three working chambers of the hydraulic cylinder, which working chambers are formed by the two working pistons, communicate on one side with the corresponding working chamber of the hydraulic cylinder on the other vehicle side through connecting lines.

This design has the advantage that for a rail vehicle equipped with two bogies, only two hydraulic cylinders are required. By the employment of only one cylinder pair with three working chambers each, also only three connecting lines are required. This design is simple, and saves weight and cost.

Each of the three connecting lines is expediently equipped with a pressure reservoir. This pressure reservoir is necessary not only for compensating for leakage losses and changes in volume at major temperature variations, but also has the advantage of furnishing an adjustable elasticity during the power transmission. In this way, the entire vehicle is less stressed, and the various oscillations which occur during the operation of the rail vehicle are reduced in a particularly favorable manner.

Referring now to the drawings in detail, the hydraulic cylinder 13 illustrated in FIG. 1*a* has two pistons 15 and 16 which divide the hydraulic cylinder into three working chambers 17, 18 and 19. The working chambers 17, 18 and 19 are filled with hydraulic oil. Each piston rod 14 is linked to one pulling-pressing rod 20 which in its turn is connected to the bogies 11 and 11' respectively.

According to FIG. 1*b*, the piston rods 14 and thus the pulling-pressing rods 20 are illustrated in their normal position, that means in a position during straightforward drive of the rail vehicle. Furthermore, the drawing shows the position of the conduits 24, 25 and 26 which interconnect the three working chambers 17, 18 and 19 of the working piston. Each of the three conduits is equipped with a pressure reservoir 21, 22 and 23.

The operation of the device will best be evident in connection with FIG. 2. Assuming that the bogies 11 and 11' move in the direction of the arrow toward the right, the connecting rods 20 on the bogie 11 are subjected to pull whereas the connecting rods 20 on the bogie 11' are subjected to pressure. The pistons 15, 15' compress the volume of the pressure medium in the working chambers 17 and 17', which pressure medium volume was preloaded by the reservoir 21. The pistons 16 and 16' similarly exert uniform pressure upon the preloaded pressure medium volume in the chambers 19 and 19'. The pressure medium in the chambers 19, 19' additionally acts upon pistons 15 and 15' respectively and thereby also upon the pressure medium volume in the chambers 17, 17'. Differential pull and pressure forces of the bogies 11 and 12 are thus cushioned or reduced in conformity with the set elastic preload. Briefly different longitudinal movements of the bogies 11, 11' relative to the main frame can be compensated for by the described hydraulic device. When the bogies 11 and 11' drive in opposite driving direction, or when the rail vehicle is braked, the described operations are carried out in the reverse sequence.

FIGS. 3, 3*a* and 3*b* show the bogies while passing through a very narrow rounded railway track section, in this instance a right hand railway track section. The rail vehicle moves in the direction of the arrow. When passing through a rounded railway track section, the bogies turn about an ideal pivot point 27, 27' respectively. In this connection, the piston 15 which is displaced in driving direction, reduces the working chamber 17, and thus displaces the pressure medium in said working chamber. The position of the other oppositely located piston 15' can be seen in FIG. 3*b*. This piston 15' moves in a direction counter to the driving direction and thus increases the working chamber 17' whereby the pressure medium displaced from the chamber 17 flows into the working chamber 17' through the connecting line 24. At the same time, the piston 16 is displaced in a direction counter to the driving direction while by reducing the working chamber 18, the pressure medium in said last mentioned working chamber 18 is displaced into the workcing chamber 18' by means of the connection 25. As a result thereof, the piston 16' is by the pressure of the pressure medium and the pressure of the rod 20 linked thereto displaced in driving direction. During this operation, the pressure medium in the chambers 19, 19' as well as in the connecting line 26 acts as a buffer. In view of the movement of the pistons 15 and 16, the working chamber 19 located therebetween is increased and receives the pressure medium displaced from the reduced working chamber 19'.

As illustrated in FIGS. 3, 3*a* and 3*b*, the bogies 11 and 11' will when passing through a rounded railway track section move into a position at an angle to the longitudinal central axis of the rail vehicle. The pulling and pressing forces which occur in this connection are by rods 20 directed into the pistons 15, 16 and 15' respectively. The total length of the hydraulic cylinder which is derived from the working chamber 17, 18 and 19 and 17', 18' and 19' respectively is so dimensioned that the pistons 15 and 16 and 15' and 16' respectively can still freely move within the hydraulic cylinder even with the smallest possible railway track radius. With unilaterally arranged piston rods 14, the piston sides defining the chambers 19, 19' have larger effective piston surfaces than the piston sides defining the chambers 17, 17' and 18, 18' respectively. As a result thereof, the bogies will with the same power development carry out different strokes. In order to reduce this phenomenon, it is suggested according to a further feature of the invention to connect the two working pistons 15, 16 of each cylinder within the region of the intermediate working chamber 19, located therebetween and to do this by a telescopically designed rod. As will be seen from FIG. 4*a*, this feature can be realized by means of a bar 38 fixedly arranged on one piston, for instance piston 16. The free end 39 of bar 38 is freely, i.e., without frictional connection, guided in the bore 40 of the other piston 15 and of the pertaining piston rod 14. According to another embodiment of this feature, the ends of bar 41 are freely guided in the bore of a piston (15 and 16) and the pertaining piston rod. The bar 41 is held in the middle between the working pistons 15 and 16 by means of springs 42 which are held on the bottom of bore 40.

Inasmuch as the piston rods 14 adapted to be subjected to a load must be greater than bores 14 arranged therein, also the diameter $D_{38}$ of the telescopically designed bars 38, 41 respectively, is less than the diameter $D_{14}$ of the piston rods 14 under load. The ratio $D_{14}/D_{38}$ should, however, be as small as possible so that the piston surfaces of the working pistons 15, 15, 15' and 16' respectively, which piston surfaces define the intermediate working chambers 19, 19' will as far as possible be equal to the piston surfaces defining the outer working chambers 17, 18 and 17', 18' respectively. The hydraulic cylinders 13 are then in a manner known per se within the region of the inner end wheel set of the bogie 11 connected below the lateral longitudinal beam of the main frame 12, whereas the pertaining piston rods 14 are respectively connected at one end to the bogie 11 by means of the pulling and pressing rods 20 which are at that end cardanically linked. Expediently, the three connecting conduits 24, 25, 26 are provided with feed valves 28, 29, 30 which are connected to a delivery pump or a pressure reservoir 34. The three connecting conduits 24, 25, 26 are furthermore provided with outlet valves 31, 32, 33 as well as with pressure reservoirs 21, 22 23 by means of which when necessary, as for instance for compensating for leakage losses, the quantity and pressure of the hydraulic fluid can be controlled in these conduits. Generally, the connecting lines 24, 25 and 26 are additionally provided with safety valves 35, 36 and 37.

In order to be able in the driver's cab of the rail vehicle at any time to observe the position of the pistons, advantageously, electric contacts are provided and arranged in such a way that if nonpermissible great deviations of the pistons 15, 16 and 15', 16' respectively from their center position, are observed or occur, a warning signal indication 44 will be released in the cab. For purposes of visually checking, the piston rods may be provided with a measuring scale by means of which a checking of the actual positions of the pistons in cylinder 13 will be possible.

It is, of course, to be understood that the present invention is, by no means, limited to the specific showing in the drawings, but also comprises any modifications within the scope of the appended claims.

What is claimed is:

1. A rail vehicle, especially self-propelled vehicle, which includes in combination: a main frame, a pair of bogies pivotable about a central axis and operatively connected with said main frame and arranged in spaced relationship to each other in the longitudinal direction of said main frame, two hydraulic cylinder-piston systems respectively arranged between and in spaced relationship to said bogies and operatively connected therewith, one of said two cylinder-piston systems being arranged on one side of said frame and the other one of said two cylinder-piston systems being arranged on the other side of said frame, said two cylinder-piston systems being located symmetrically with regard to the longitudinal central axis of said rail vehicle, two pairs of pressure and pull rods respectively interposed between said cylinder-piston systems and each bogie of said pair of bogies, each cylinder-piston system having two separately acting working pistons dividing the pertaining cylinder into two end and one intermediate working chambers, each of the two separately acting working pistons of each cylinder-piston system being respectively pivotally connected to one end of one rod of said pair of pressure and pull rods while the other ends of said pressure and pull rods are respectively pivotally connected to the pertaining bogie of said pair of bogies, and three conduit means for establishing communication between the three respective working chambers of one cylinder-piston system with the corresponding working chambers of the other cylinder-piston system for transmitting pulling and braking forces between bogies and said main frame furnishing an adjustable elasticity during power transmission.

2. A rail vehicle in combination according to claim 1, in which a telescopic rod arrangement interconnects said two working pistons within an intermediate working chamber therebetween.

3. A rail vehicle in combination according to claim 1, in which a pressure storage means, a feeding valve, and a safety valve are provided in each of said conduit means.

4. A rail vehicle in combination according to claim 1, which includes a warning signal indicator operatively connected to said cylinder piston systems and operable in response to the respective working piston performing a working stroke in excess of its normal working stroke to give off a signal.

* * * * *